United States Patent [19]

Ishikawa et al.

[11] Patent Number: 4,836,169

[45] Date of Patent: Jun. 6, 1989

[54] ENGINE CONTROL APPARATUS

[75] Inventors: Hideaki Ishikawa, Katsuta; Taiji Hasegawa, Nakaminato, both of Japan

[73] Assignee: Hitachi, Ltd., Tokyo, Japan

[21] Appl. No.: 159,904

[22] Filed: Feb. 24, 1988

[30] Foreign Application Priority Data

Mar. 13, 1987 [JP] Japan ..... 62-56614

[51] Int. Cl.[4] ..... F02D 41/10; F02M 51/00

[52] U.S. Cl. ..... 123/480; 123/478

[58] Field of Search ..... 123/480, 478, 406, 417, 123/424

[56] References Cited

U.S. PATENT DOCUMENTS 4,664,085 8/1987 Kataoka ..... 123/478

4,683,857 8/1987 Yasuoka ..... 123/478

4,753,206 6/1988 Inoue et al. ..... 123/478

*Primary Examiner*—Raymond A. Nelli

*Attorney, Agent, or Firm*—Antonelli, Terry & Wands

[57] ABSTRACT

An engine control apparatus comprises a plurality of sensors for detecting the operation state of an engine, means for calculating, on the basis of signals produced from the sensors, a correction amount which corrects a predetermined controllable quantity, means for calculating a learned correction amount by averaging values of the correction amount by a reference occurrence frequency, means for calculating, under a predetermined condition, the learned correction amount by averaging values of the correction amount by an occurrence frequency which is smaller than the reference occurrence frequency, and means for correcting the controllable quantity in accordance with the correction amount and the learned correction amount.

4 Claims, 4 Drawing Sheets

ENGINE CONTROL APPARATUS

BACKGROUND OF THE INVENTION

This invention relates to an apparatus for controlling an engine such as an internal combustion engine and more particularly to an engine control apparatus having a learning control function.

An engine control apparatus having a learning control function is disclosed in, for example, JP-A-59-180048. As is clear from the disclosure of this publication, in the conventional engine control apparatus having the learning control function, irregularity in the characteristics of the engine per se, and the irregularity and secular variation in characteristics of sensors adapted to detect the status of the engine, are corrected using a learning control function. In this way, various controllable quantities, such as for example air/fuel ratio and ignition timing, can be controlled optimumly.

In the conventional engine control apparatus as exemplified in the aforementioned publication, however, the control speed for learning control is unchangeable and it takes a long time to obtain optimum engine control through the learning control.

The control speed for learning control is desired to be high during a predetermined condition thereby placing the engine in an optimumly controlled condition through the learning control within a short period of time following the commencement of use by the user.

SUMMARY OF THE INVENTION

An object of this invention is to provide an engine control apparatus which can obtain, within a relatively short period of time, correction amounts for correcting irregularity in characteristics of the engine per se and irregularity in characteristics of various sensors so as to control the engine optimumly.

According to the invention, to accomplish the above object, an engine control apparatus for controlling at least the fuel supply amount representative of the controllable quantities by fetching signals from the sensors adapted to detect the status of the engine comprises learning control means for controlling the controllable quantity on the basis of the signals from the sensors, and control speed changing means for changing, under a predetermined condition, the control speed for the learning control means to a value which is higher than a reference value.

With this construction, the control speed changing means sets, under the predetermined condition, the control speed for learning control to a higher value than the reference value so that the engine can be placed in an optimumly controlled condition through the learning control within a short period of time following the commencement of use by the user. At the expiration of a predetermined period of time, the control speed for learning control is set to the reference value.

DESCRIPTION OF THE PREFERRED EMBODIMENT

An engine control apparatus according to a preferred embodiment of the invention will now be described with reference to FIGS. 1 to 6.

Figure 1:
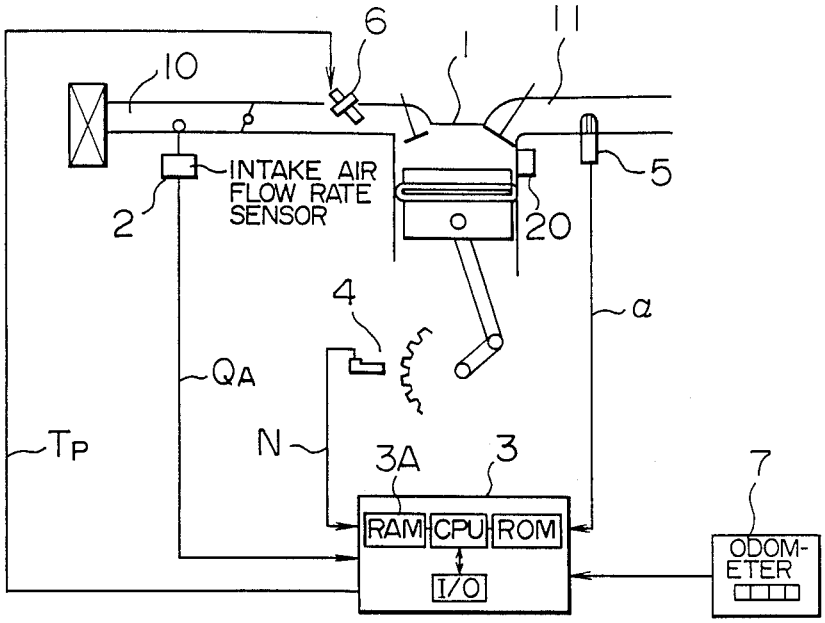
FIG. 1 is a schematic block diagram showing an engine control apparatus according to an embodiment of the invention.

Firstly, referring to FIG. 1, an engine 1 has an intake conduit 10 in which an intake air flow rate sensor 2 is disposed having an output terminal connected to a control console 3. Disposed near one end of the intake conduit 10 is an injector 6 for fuel injection to the engine 1, the injector 6 having an input terminal connected to the control console 3.

In an exhaust conduit 11 of the engine 1 is an oxygen ($O_2$) sensor 5 having an output terminal connected to the control console 3. In this embodiment, the pulse width for fuel injection to the engine 1 is controlled on the basis of a concentration of oxygen in the exhaust gas which is detected by the $O_2$ sensor 5.

A crank angle sensor 4 rotates in synchronism with the rotation of the engine 1 to produce an engine revolution number signal which is applied to the control console 3, and an odometer 7 is connected to the control console 3 to supply thereto a signal indicative of the running distance of the vehicle.

The engine control apparatus constructed as above operates as will be described below.

Where $Q_A$ is the intake air amount which is calculated by the control console 3 on the basis of a flow rate signal measured by the intake air flow rate sensor 2, N is the engine revolution number (per unit time) which is calculated by the control console 3 on the basis of an engine revolution number signal in the form of pulses produced from the crank angle sensor 4 each time the engine rotates a predetermined angle and k is a constant, the control console 3 calculates the pulse width $T_P$ for fuel injection in accordance with the following equation:

$$T_P = k \times Q_A / N \quad (1)$$

The fuel injection amount based on the pulse width $T_P$ for fuel injection as obtained from equation (1) is feedback controlled using a signal produced from the $O_2$ sensor 5. More specifically, where $\alpha$ is the feedback correction coefficient and $\alpha_L$ is the learning correction coefficient obtained through learning control, the control console 3 comprised of a microcomputer calculates the corrected pulse width Ti for fuel injection in accordance with the following equation:

$$T_i = T_P \times (\alpha + \alpha_L) \quad (2)$$

The ultimate pulse width for fuel injection to the injector 6 is controlled pursuant to equation (2).

Figure 2:
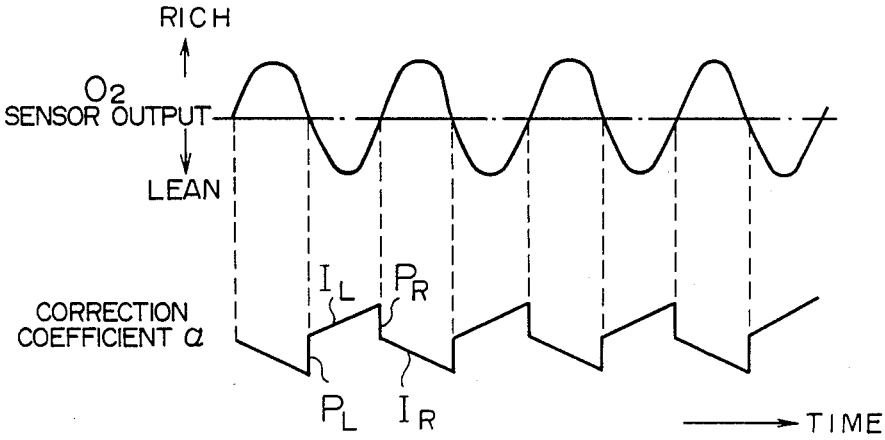
FIG. 2 is a time chart showing a correction coefficient changing with the operation of the FIG. 1 apparatus.

The correction coefficient $\alpha$ in equation (2) can be obtained through proportional integration control corresponding to the output signal of the $O_2$ sensor 5, as shown in FIG. 2. More particularly, when the air/fuel ratio changes from "LEAN" to "RICH", for the purpose of rapid controlling, the proportional portion, $P_R$, is subtracted and thereafter the integration portion at the rate of $I_R$ is subtracted. Conversely, when the air/fuel ratio changes from "RICH" to "LEAN", for the purpose of rapid controlling, the proportional portion, $P_L$, is added and thereafter the integration portion at the rate of $I_L$ is added.

This conventionally available correction based on the correction coefficient $\alpha$ alone, however, fails to correct errors in control attributable to the difference in individuality of the engines per se of vehicles and manufacturing errors (irregularity) or secular variation in the various sensors. Accordingly, it has hitherto been also the practice to effect a further correction by using the learning correction coefficient $\alpha_L$ obtained through learning control. The learning correction coefficient $\alpha_L$ is defined by an average of values of the correction coefficient $\alpha$.

Figure 3:
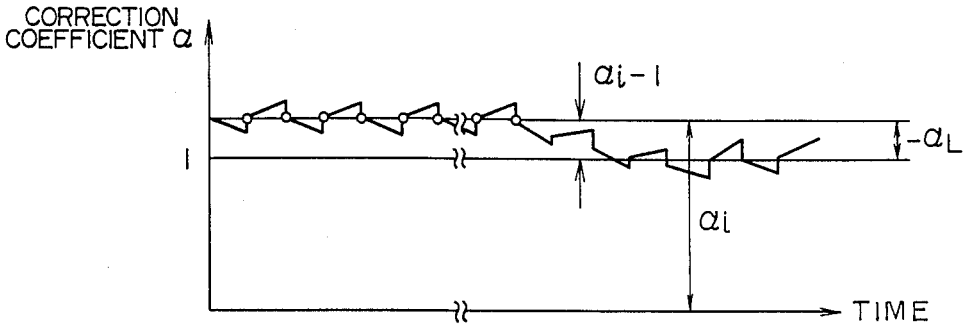
FIG. 3 is a time chart showing a change in the correction coefficient through learning control in the FIG. 1 apparatus.

Therefore, when the air/fuel ratio changes from fuel "RICH" to fuel "LEAN" or conversely from fuel "LEAN" to fuel "RICH", values of $\alpha$ are averaged to determine a value of $\alpha_L$ as shown in FIG. 3. The value of $\alpha_L$ is $-\alpha_L$ in this example. Values of the learning correction coefficient $\alpha_L$ are obtained in relation to various running states and are stored in a RAM 3A of the control console 3, as shown in FIG. 4.

Figure 4:
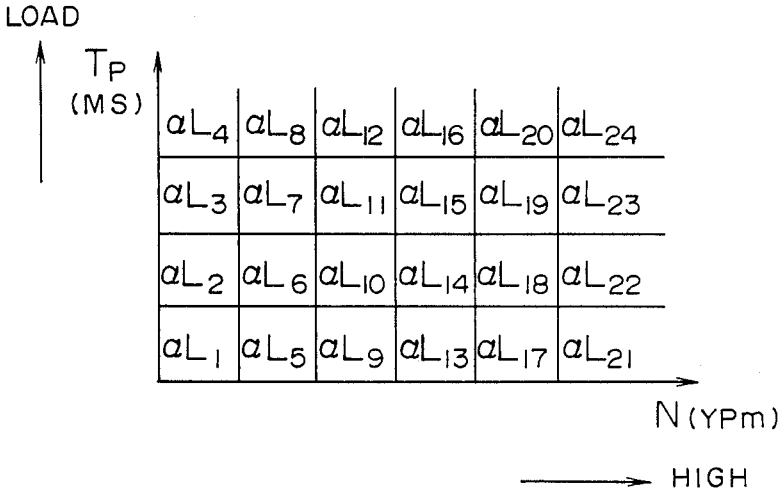
FIG. 4 illustrates a map of learning correction coefficient data in a RAM obtained through learned controlling in the FIG. 1 apparatus.

In FIG. 4, data values of the learning correction coefficient $\alpha_L$ are related to the running state in which the engine speed becomes higher as the revolution number N changes to the right on the abscissa and the fuel becomes rich, i.e., the load on the engine becomes higher as the pulse width $T_P$ for fuel injection changes upwards. Data values $\alpha L_1$ to $\alpha L_{24}$ stored in the RAM 3A in relation to various operation or running states of the engine are not obtained by uniformly averaging values of $\alpha$. Specifically, data values $\alpha L_6$, $\alpha L_7$, $\alpha L_{10}$, $\alpha L_{11}$, $\alpha L_{14}$, $\alpha L_{15}$, $\alpha L_{18}$ and $\alpha L_{19}$ on almost the central area in FIG. 4 are related to engine states which occur relatively frequently and can be obtained by averaging many (for example, ten) values of $\alpha$. But data values on the peripheral area (for example, $\alpha L_1$, $\alpha L_4$, $\alpha L_{21}$ and $\alpha L_{24}$) are related to engine states which occur infrequently and if these data values $\alpha Li$ are to be determined by the conventional method which is designed to average, for example, ten values of $\alpha$, these data values on the peripheral area will remain undetermined for a long time. When under this condition, if the engine states which are expected to occur infrequently occur, there results a problem that optimum engine controlling can not be performed by the conventional method.

To solve this problem, the present invention has the feature that, for example, for a small running distance attributed to a new car, in view of the fact that the new car has poor experience in learning, values of $\alpha$ are averaged by a relatively small number (for example, five) to determine data values $\alpha Li$, whereby data values $\alpha Li$ on the entire area of the map of FIG. 4 can be obtained within a relatively short period of time to meet control requirements for all engine states. By using the thus obtained $\alpha$ and $\alpha L$, the air/fuel ratio can be controlled optimumly pursuant to equation (2)

Figure 5:
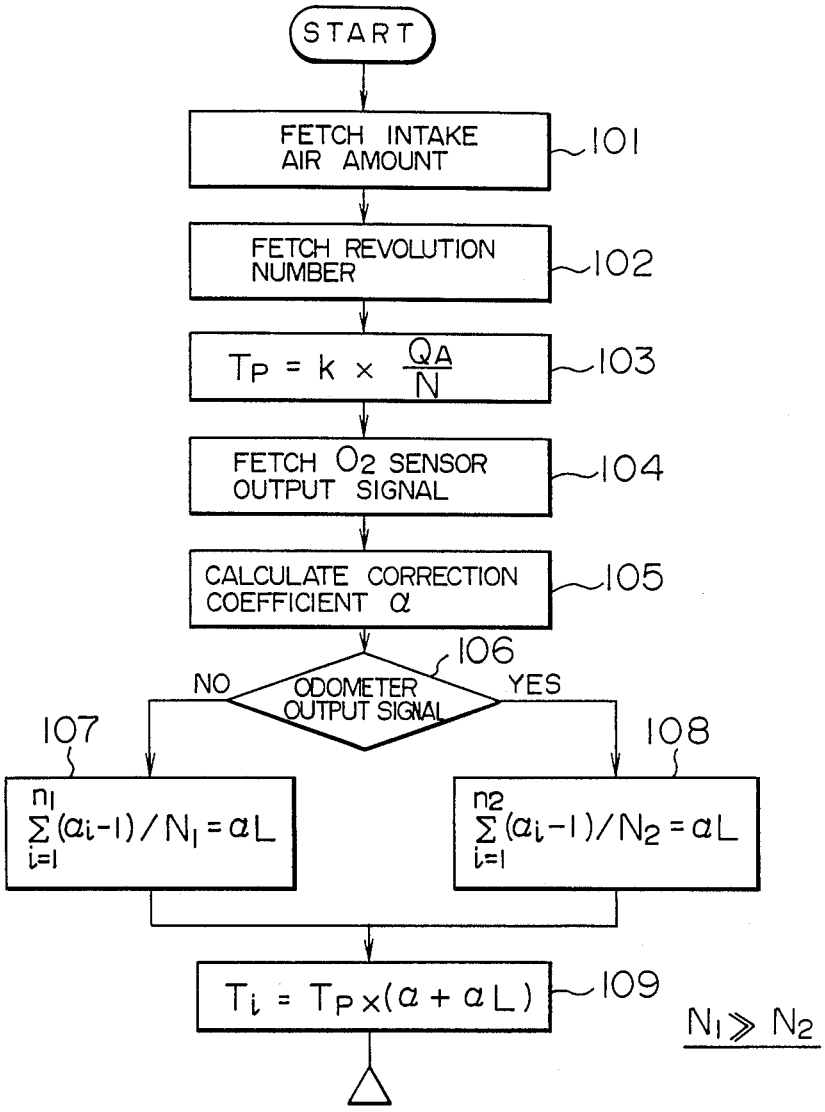
FIG. 5 is a flow chart showing the operation of the FIG. 1 apparatus.

Referring to FIG. 5, the operational procedure to this end will be described. In step 101, the intake air amount $Q_A$ is calculated in accordance with a flow rate signal produced from the intake air flow rate sensor 2 and in step 102, the engine revolution number N is calculated in accordance with an engine revolution number signal produced from the crank angle sensor 4.

Subsequently, in step 103, the pulse width $T_P$ for fuel injection is calculated pursuant to equation (1) and in step 104, a signal produced from the $O_2$ sensor 5 is fetched. In step 105, the correction coefficient $\alpha$ is calculated on the basis of the signal of the $O_2$ sensor 5 fetched in step 104 through the proportional integration controlling as previously described in connection with FIG. 2, in a manner well known by itself.

The procedure then proceeds to step 106 in which it is decided from a running distance signal produced from the odometer 7 whether the running distance of the vehicle is below I Km.

If the running distance of the vehicle is decided to be below I Km in step 106, the learning correction coefficient $\alpha_L$ is calculated, in step 108, pursuant to the following equation:

$$\sum_{i=1}^{n_2} (\alpha_i - 1)/N_2 = \alpha_L \tag{3}$$

If the running distance of the vehicle is decided to exceed I Km in step 106, the learned correction coefficient $\alpha_L$ is calculated, in step 107, pursuant to the following equation:

$$\sum_{i=1}^{n_1} (\alpha_i - 1)/N_1 = \alpha_L \tag{4}$$

Since $N_1$ in equation (4) is related to $N_2$ in equation (3) by $N_1 >> N_2$, data values of the learning correction coefficient $\alpha_L$ can be calculated and determined through learning control within a short period of time.

Finally, in step 109, the learning correction coefficient $\alpha_L$ determined pursuant to equation (3) or (4) and the correction coefficient $\alpha$ determined in step 105 are used to calculate the pulse width Ti for fuel injection pursuant to equation (2).

As described above, according to this embodiment of the invention, the control speed for learning control is set to a higher value before the vehicle reaches a predetermined running distance, thereby ensuring that the air/fuel ratio can be controlled optimumly within a short period of time following the commencement of use by the user.

Figure 6:
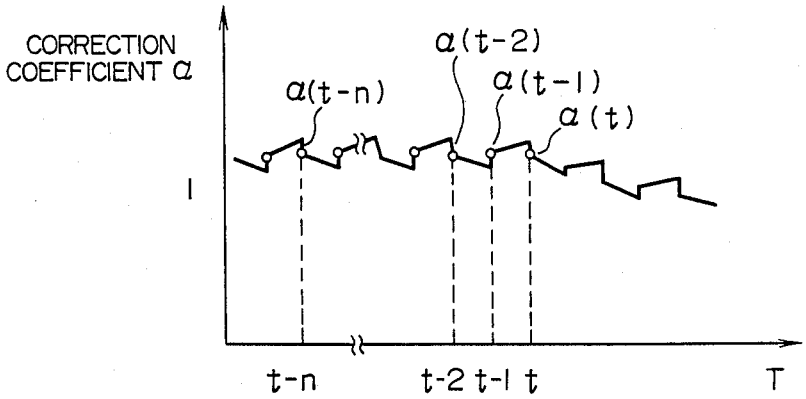
FIG. 6 is a time chart showing another example of a change in the correction coefficient through learning control in the FIG. 1 apparatus.

FIG. 6 shows another way to obtain the learning correction coefficient $\alpha_L$ through learning control. In this example, values of $\alpha$ represented by $\alpha(t)$, $\alpha(t-1)$, - - - $\alpha(t-n)$ are multiplied by desired weight coefficients $k_0$, $k_1$, - - - $k_n$, respectively, to calculate the learning correction coefficient $\alpha_L$ pursuant to the following equation:

$$\alpha_L = k_0 \cdot \alpha(t) + k_1 \cdot \alpha(t-1) - - - + k_n \cdot \alpha(t-n) \tag{5}$$

In this case, the time for obtaining values of the learning correction coefficient $\alpha_L$ through learning control can also be minimized by changing values of the weight coefficients $k_0$, $K_1$, - - - $k_n$ and consequently optimum control can be performed through learning control within a short period of time following the commencement of use by the user.

While in the foregoing embodiment the control speed for learning control has been described as being set to a high value before the running distance of the vehicle reaches a predetermined value, the frequency of turn-on operations of the ignition switch and start switch may be counted so that when the frequency of the turn-on operations is below a predetermined value, the control speed for learning control may be set to a higher value. Through the use of the frequency of the turn-on operations of the ignition switch and start switch in this manner, even when old learning control data is destroyed because of disconnection of the battery effected for repair and inspection, the control speed for learning control can readily be set to the higher value before the frequency of the turn-on operations of the ignition switch and start switch, starting from the beginning of re-connection of the battey, reaches the predetermined value.

Particularly, automobiles produced in an automobile production factory can be tested in the factory before consignment in a simulation running mode corresponding to a predetermined running mode (Ten mode or LA-4 mode) so as to cause various engine states to occur and accordingly, the engine states can be learned by the automobiles, in advance of consignment thereof, to complete necessary data on the entire area of the RAM.

Although in the foregoing embodiment the learning control has been described as applied to fuel injection, the present invention is not limited thereto but may also be applied to, for example, ignition timing control, air/fuel ratio control, idling control and EGR (Exhaust Gas Recycle) control. In the case of ignition timing control, the $O_2$ sensor 5 may be replaced with a sensor 20 for detecting the combustion state of the engine such as for example a knocking sensor and a combustion pressure sensor.

As has been described, according to the invention, the engine control apparatus can be provided wherein the control speed for learning control is increased under the predetermined condition to permit optimum engine control through learning control within a short period of time following the commencement of use by the user.

We claim:

1. An engine control apparatus comprising:

a plurality of sensors for detecting selected states of an engine;

first calculating means for calculating, on the basis of signals produced from said sensors, a correction amount which corrects a predetermined controllable quantity;

second calculating means for calculating a learning correction amount by averaging values of said correction amount at a predetermined reference occurrence frequency of sampled correction amount values;

means for controlling said second calculating means, in response to detection of a predetermined condition, by changing the occurrence frequency at which sampled values of the correction amount are averaged to an occurrence frequency which is smaller than said predetermined reference occurrence frequency; and means for correcting said controllable quantity in accordance with said correction amount and said learning correction amount.

2. An engine control apparatus according to claim 1 wherein said plurality of sensors include a vehicle running distance sensor, an intake air flow rate sensor, an engine revolution number sensor and an oxygen sensor, said controllable quantity is a fuel supply amount, and said predetermined condition is determined on the basis of an output signal produced from said vehicle running distance sensor.

3. An engine control apparatus according to claim 1 wherein said plurality of sensors include a vehicle running distance sensor, an intake air flow rate sensor, an engine revolution number sensor and an engine state sensor, said controllable quantity is the ignition timing, and said predetermined condition is determined on the basis of an output signal produced from said vehicle running distance sensor.

4. An engine control apparatus according to claim 1 wherein said plurality of sensors include an intake air flow rate sensor, an engine revolution number sensor and an oxygen sensor, said controllable quantity is the fuel supply amount, and said predetermined condition is determined on the basis of a frequency of turn-on operations of an engine start switch.

* * * * *